US012290195B2

(12) United States Patent
Zou

(10) Patent No.: US 12,290,195 B2
(45) Date of Patent: May 6, 2025

(54) ROTATABLE ARTIFICIAL TREE

(71) Applicant: Xinjiang Zou, Meizhou (CN)

(72) Inventor: Xinjiang Zou, Meizhou (CN)

( * ) Notice: Subject to any disclaimer, the term of this patent is extended or adjusted under 35 U.S.C. 154(b) by 93 days.

(21) Appl. No.: 18/380,997

(22) Filed: Oct. 17, 2023

(65) Prior Publication Data

US 2025/0098888 A1 Mar. 27, 2025

(30) Foreign Application Priority Data

Sep. 25, 2023 (CN) ..... 202322598909.9

(51) Int. Cl.
*A47G 33/06* (2006.01)
*A47G 33/12* (2006.01)

(52) U.S. Cl.
CPC ..... *A47G 33/06* (2013.01); *A47G 33/126* (2013.01)

(58) Field of Classification Search
CPC ..... A47G 33/06
See application file for complete search history.

(56) References Cited

U.S. PATENT DOCUMENTS 1,971,300 A * 8/1934 Garrett ..... A47G 33/126 248/527
2,587,788 A * 3/1952 Tacy ..... A47G 33/126 248/176.1
2,674,147 A * 4/1954 Donald ..... A47G 33/126 248/482
5,647,569 A * 7/1997 Sofy ..... A47G 33/126 248/522
6,536,721 B1 * 3/2003 Kao ..... A47G 33/126 248/522
8,132,360 B2 * 3/2012 Jin ..... A47G 33/126 47/40.5
11,276,952 B1 * 3/2022 Zou ..... H01R 24/86
11,641,968 B1 * 5/2023 Zou ..... A47G 33/126 362/249.14

FOREIGN PATENT DOCUMENTS

CN 219042652 U 5/2023

* cited by examiner

*Primary Examiner* — Alexander K Garlen
(74) *Attorney, Agent, or Firm* — Birchwood IP

(57) ABSTRACT

Provided is a rotatable artificial tree. The rotatable artificial tree includes an artificial tree body, a rotatable electric assembly and a supporting base. The artificial tree body is provided with decorative light strings and a trunk, and the supporting base is provided with a driving motor. The rotatable electric assembly includes a rotating shaft core which is connected with a power output shaft of the driving motor in a non-rotating manner and vertically arranged. The rotating shaft core is connected with the trunk in a driving manner. A conductive ring mounting sleeve which rotates synchronously with the rotating shaft core sleeves the periphery of the rotating shaft core. At least two metal conductive rings which are arranged at an insulating interval from top to bottom and are respectively in a circular ring shape sleeve the periphery of the conductive ring mounting sleeve.

8 Claims, 4 Drawing Sheets

ROTATABLE ARTIFICIAL TREE

CROSS-REFERENCE TO RELATED APPLICATIONS

This is a U.S. patent application which claims the priority and benefit of Chinese Patent Application Number 202322598909.9, filed on Sep. 25, 2023, the disclosure of which is incorporated herein by reference in its entirety.

TECHNICAL FIELD

The present disclosure relates to the technical field of artificial trees, in particular to a rotatable artificial tree.

BACKGROUND

In a Chinese utility model patent, the patent number is ZL202222477137.9, and the patent name is ROTATABLE ELECTRIC MOUNTING BASE AND ARTIFICIAL TREE USING ELECTRIC MOUNTING BASE. In a United States patent, the United States patent number is U.S. Pat. No. 11,641,968B1, and the patent names is ROTATABLE ELECTRIC MOUNTING BASE AND ARTIFICIAL TREE USING ELECTRIC MOUNTING BASE. Specifically, the rotatable artificial tree includes an artificial tree body, a rotatable electric mounting base and decorative string lights arranged on the artificial tree body, and the artificial tree body is provided with a trunk. The rotatable electric mounting base includes a base body and a mounting shaft, the trunk of the artificial tree body is inserted into the mounting shaft, and a driving motor of the base body drives the mounting shaft to rotate. An electric device sleeves the periphery of the mounting shaft. The electric device includes an upper connector assembly and a lower connector assembly. The upper connector assembly includes an upper connector body sleeving the periphery of the mounting shaft in a 360-degree circumferential rotation manner. The lower connector body is buckled and fastened to the base body. The lower connector body is provided with a lower electric connector. The upper connector body is provided with an upper connector connecting wire, an upper electric connector, a metal conductive spring and a metal conductive needle which are electrically connected in sequence. The metal conductive spring elastically presses against the metal conductive needle, and the metal conductive needle is electrically conductive with the lower electric connector.

It should be pointed out that the rotatable artificial tree has the following defects. Specifically, the upper connector assembly of the electric device includes an upper connector body, and an upper connector connecting wire, an upper electric connector, a metal conductive spring and a metal conductive needle which are electrically connected in turn, and the lower connector assembly includes a lower connector body and a lower electric connector. The electric device is complex in structure and inconvenient.

SUMMARY

The present disclosure aims to provide a rotatable artificial tree aiming at the defects in the prior art. The rotatable artificial tree is novel in design, simple in structure and convenient to assemble.

In order to achieve the above purpose, the present disclosure adopts the following technical scheme.

A rotatable artificial tree includes an artificial tree body, a rotatable electric assembly and a supporting base. The artificial tree body is provided with decorative light strings and a trunk which is vertically arranged. The supporting base is provided with a driving motor.

The rotatable electric assembly includes a rotating shaft core which is connected with a power output shaft of the driving motor in a non-rotating manner and vertically arranged. The rotating shaft core is connected with the trunk of the artificial tree body in a driving manner. A conductive ring mounting sleeve which rotates synchronously with the rotating shaft core sleeves the periphery of the rotating shaft core. At least two metal conductive rings which are arranged at an insulating interval from top to bottom and are respectively in a circular ring shape sleeve the periphery of the conductive ring mounting sleeve. The decorative light strings are electrically connected with the metal conductive rings through wires.

The supporting base is respectively provided with metal contacts corresponding to the metal conductive rings. Each metal contact is in contact with the corresponding metal conductive ring and is electrically conductive.

Wherein, the supporting base is respectively provided with contact mounting parts corresponding to the metal contacts. Each contact mounting part is respectively provided with a contact clamping groove. Each metal contact is respectively clamped and fixed in the corresponding contact clamping groove.

Wherein, the metal contact is C-shaped, and includes a contact base and contact extension parts symmetrically arranged at both ends of the contact base. Each contact extension part is respectively provided with an elastic contact part.

Each metal conductive ring is respectively located between two contact extension parts of the corresponding metal contact, and the elastic contact part of each contact extension part elastically press against the metal conductive ring respectively.

Wherein, an upper end of the supporting base is rotatably provided with a linkage sleeve. An upward insertion hole is formed in a core of the linkage sleeve. A lower end of the trunk the artificial tree body is inserted into the insertion hole of the linkage sleeve.

A lower end of the linkage sleeve is in sleeve connection with an upper end of the rotating shaft core in a non-rotating manner.

Wherein, a circle of bottom balls are arranged between a lower surface of the linkage sleeve and the supporting base, and the lower surface of the linkage sleeve is in rolling contact with the bottom balls.

Wherein, the upper end of the supporting base is screwed and fastened with a gland in the shape of a ring. A ball mounting groove in the shape of a ring is formed between the gland and the supporting base. A circle of side balls are arranged in the ball mounting groove. A side wall of the linkage sleeve is in rolling contact with the side balls.

Wherein, the supporting base is provided with a positive and negative rotation control switch for controlling the positive and negative rotation of the driving motor.

Wherein, the supporting base is provided with a rotating speed control knob for adjusting the rotating speed of the driving motor.

The present disclosure has the following beneficial effects. The present disclosure provides a rotatable artificial tree. The rotatable artificial tree includes an artificial tree body, a rotatable electric assembly and a supporting base. The artificial tree body is provided with decorative light strings and a trunk which is vertically arranged, and the supporting base is provided with a driving motor. The rotatable electric assembly includes a rotating shaft core which is connected with a power output shaft of the driving motor in a non-rotating manner and vertically arranged. The rotating shaft core is connected with the trunk in a driving manner. A conductive ring mounting sleeve which rotates synchronously with the rotating shaft core sleeves the periphery of the rotating shaft core. At least two metal conductive rings which are arranged at an insulating interval from top to bottom and are respectively in a circular ring shape sleeve the periphery of the conductive ring mounting sleeve. The decorative light strings are electrically connected with the metal conductive rings through wires. The supporting base is respectively provided with metal contacts corresponding to the metal conductive rings, and each metal contact is in contact with the corresponding metal conductive ring and is electrically conductive. Through the structural design, the rotatable artificial tree has the advantages of being novel in design, simple in structure and convenient to assemble.

BRIEF DESCRIPTION OF DRAWINGS

The present disclosure is further illustrated below with the use of the accompanying drawings, but the embodiments in the accompanying drawings do not constitute any limitation of the present disclosure.

Reference signs in FIG. 1 to FIG. 4:

1, artificial tree body; 11, trunk; 12, decorative light string; 2, rotatable electric assembly; 21, rotating shaft core; 22, conductive ring mounting sleeve; 23, metal conductive ring; 24, metal contact; 241, contact base; 242, contact extension part; 243, elastic contact part; 3, supporting base; 31, contact mounting part; 32, contact clamping groove; 4, driving motor; 5, linkage sleeve; 51, insertion hole; 61, bottom ball; 62, side ball; 7, gland; 8, ball mounting groove; 91, positive and negative rotation control switch; and 92, rotating speed control knob.

DETAILED DESCRIPTION

The present disclosure is described below in combination with specific embodiments.

Figure 1:
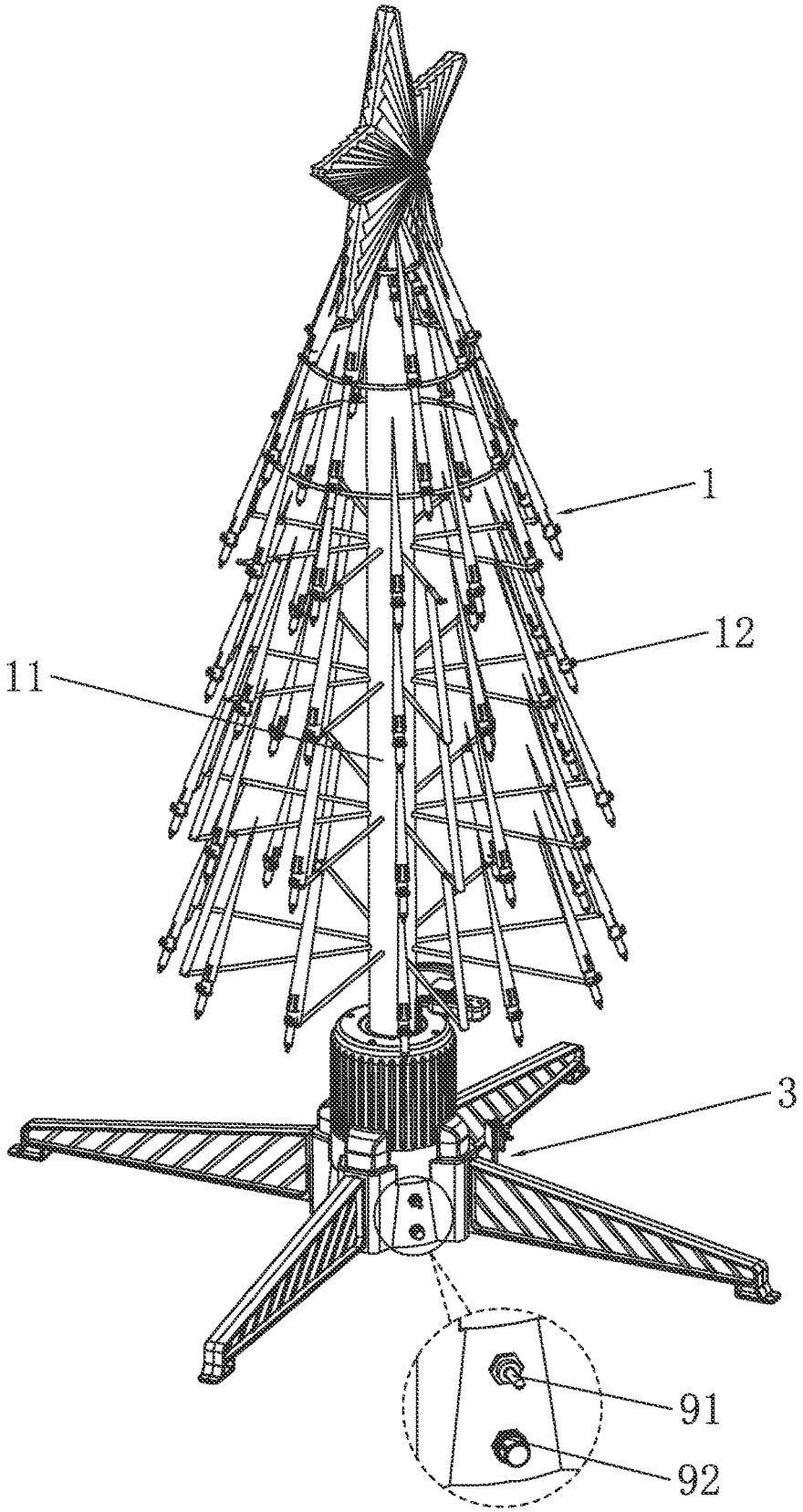
FIG. 1 is a structural schematic diagram of the present disclosure.
Figure 2:
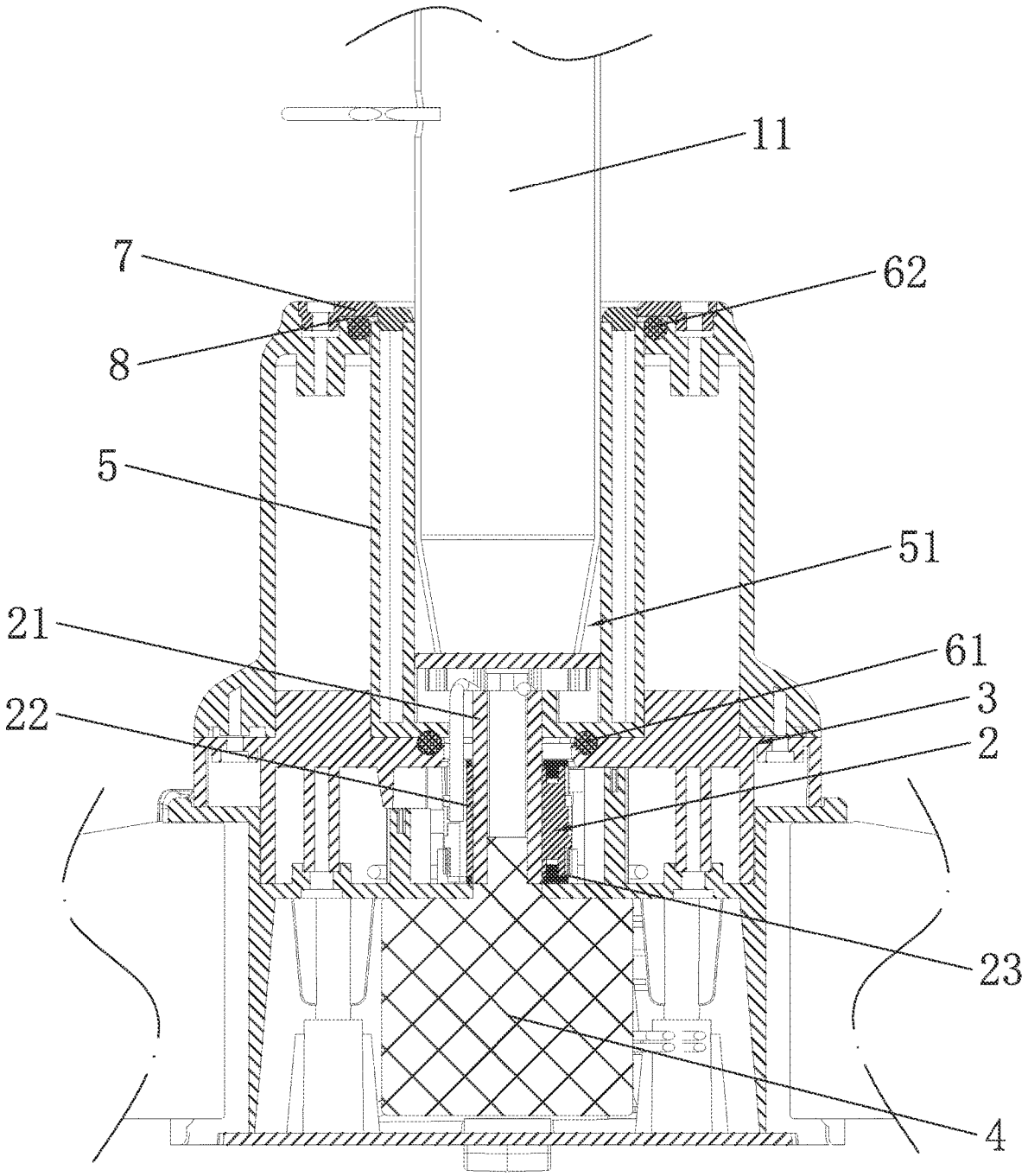
FIG. 2 is a local cross-section diagram of the present disclosure.

In the first embodiment, as shown in FIG. 1 and FIG. 2, a rotatable artificial tree includes an artificial tree body 1, a rotatable electric assembly 2 and a supporting base 3. The artificial tree body 1 is provided with decorative light strings 12 and a trunk 11 which is vertically arranged. The supporting base 3 is provided with a driving motor 4.

Figure 3:
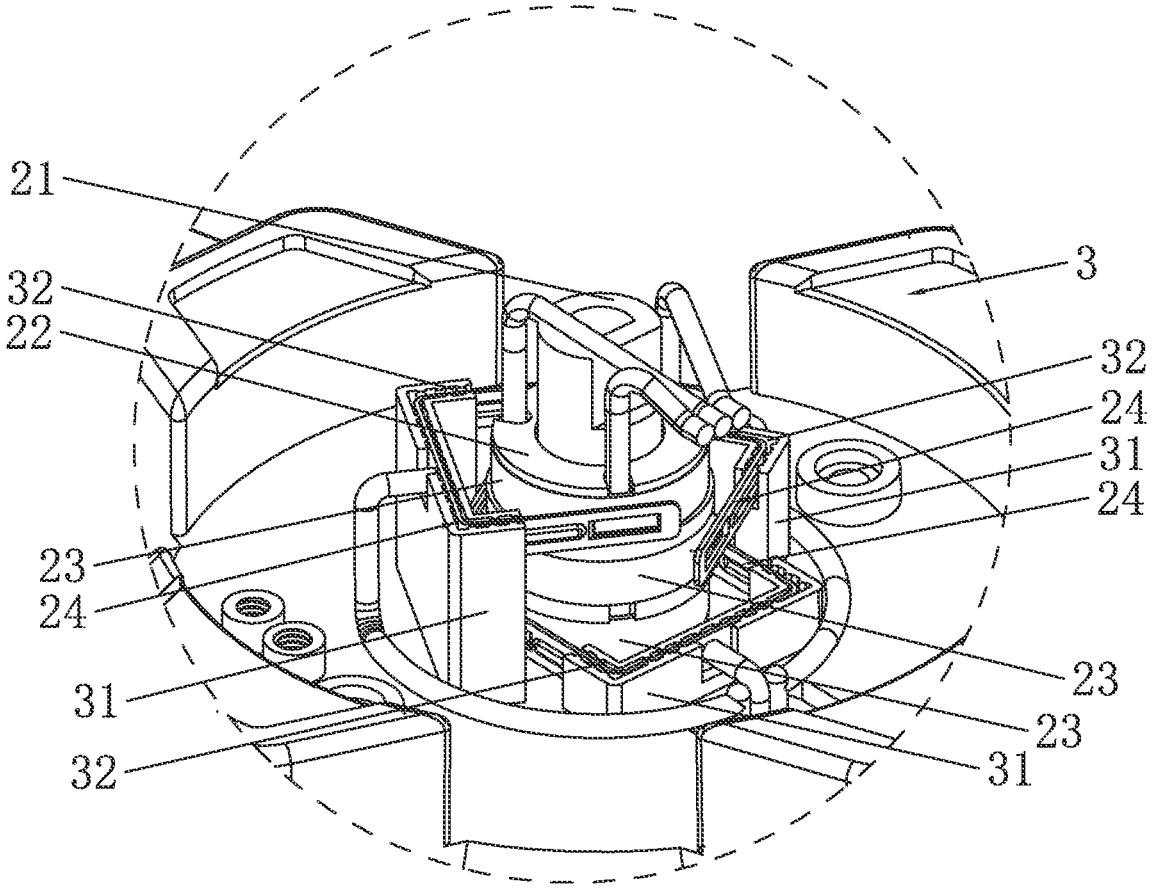
FIG. 3 is a partial enlarged drawing of the present disclosure.

Further, as shown in FIG. 2 and FIG. 3, the rotatable electric assembly 2 includes a rotating shaft core 21 which is connected with a power output shaft of the driving motor 4 in a non-rotating manner and vertically arranged. The rotating shaft core 21 is connected with the trunk 11 of the artificial tree body 1 in a driving manner, A conductive ring mounting sleeve 22 which rotates synchronously with the rotating shaft core 21 sleeves the periphery of the rotating shaft core 21. At least two metal conductive rings 23 which are arranged at an insulating interval from top to bottom and are respectively in a circular ring shape sleeve the periphery of the conductive ring mounting sleeve 22. The decorative light strings 12 are electrically connected with the metal conductive rings 23 through wires.

Figure 4:
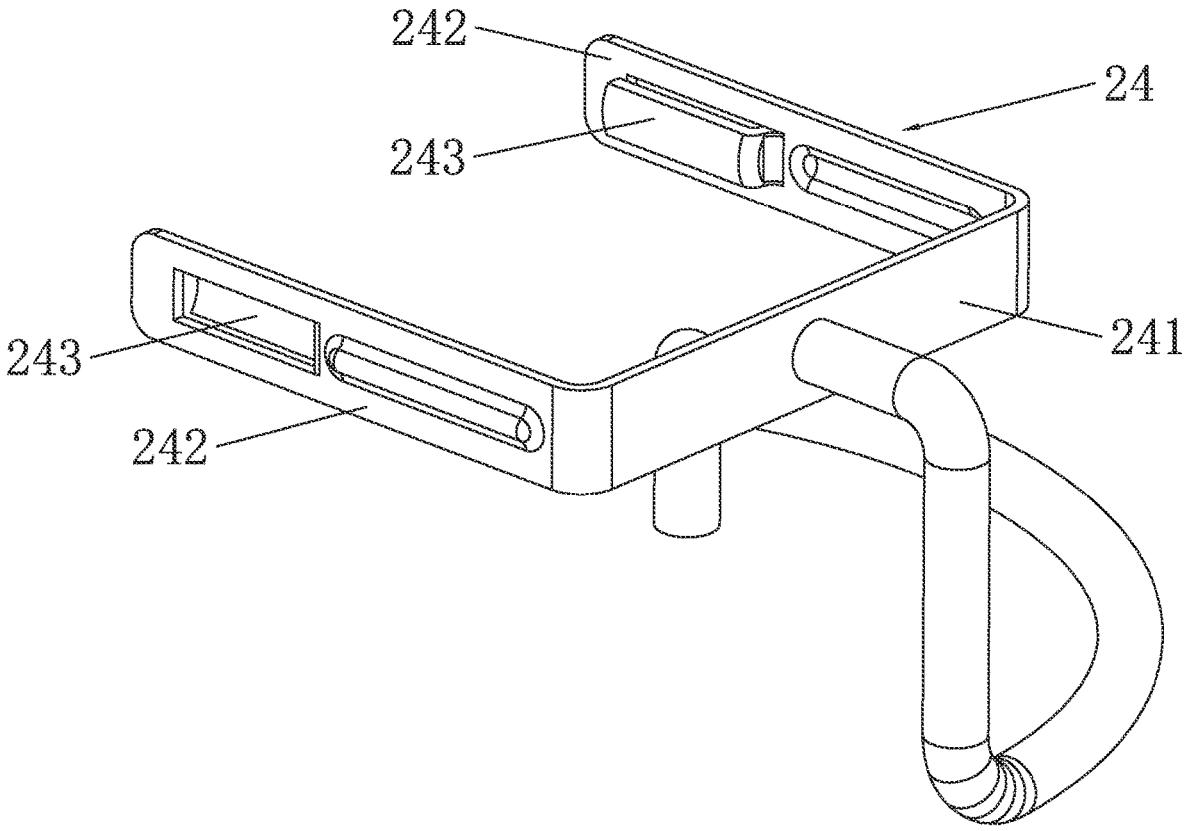
FIG. 4 is a structural schematic diagram of a metal contact in the present disclosure.

Further, as shown in FIG. 2 to FIG. 4, the supporting base 3 is respectively provided with metal contacts 24 corresponding to the metal conductive rings 23. Each metal contact 24 is in contact with the corresponding metal conductive ring 23 and is electrically conductive.

It should be noted that, for the rotatable artificial tree according to the first embodiment, the metal contacts are electrically connected with an external power supply through wires, and wires connected to the metal conductive rings 23 can be electrically connected with the decorative light strings 12 of the artificial tree body 1 through plugging connectors. In working hours, the driving motor 4 starts and drives the rotating shaft core 21 to rotate, the rotating shaft core 21 drives the trunk 11 of the artificial tree body 1 to rotate, and then the whole artificial tree body 1 rotate. In this process, the conductive ring mounting sleeve 22 and each metal conductive ring 23 mounted on the conductive ring mounting sleeve 22 respectively rotate synchronously with the rotating shaft core 21, namely each metal conductive ring 23 is in sliding contact with the corresponding metal contact 24 and is electrically conductive.

It should be emphasized that the rotatable electric assembly 2 in the first embodiment includes a rotating shaft core 21, a conductive ring mounting sleeve 22, a metal conductive ring 23 and a metal contact 24, so that the overall structure is simple. During assembling, the rotating shaft core 21 is mounted on the power output shaft of the driving motor 4, and the conductive ring provided with the metal conductive ring 23 sleeves the rotating shaft core 21 to ensure that each metal conductive ring 23 is in contact with the corresponding metal contact 24, so that the assembly is convenient and quick.

In these circumstances, by means of the structural design, the rotatable artificial tree in the first embodiment has the advantages of being novel in design, simple in structure and convenient to assemble.

In the second embodiment, as shown in FIG. 3, the difference between the second embodiment and the first embodiment lies in that the supporting base 3 is respectively provided with contact mounting parts 31 corresponding to the metal contacts 24. Each contact mounting part 31 is respectively provided with a contact clamping groove 32. Each metal contact 24 is respectively clamped and fixed in the corresponding contact clamping groove 32.

The mounting structure of the metal contact 24 has the advantage of being convenient and quick to mount.

In the third embodiment, as shown in FIG. 4, the difference between the third embodiment and the first embodiment lies in that the metal contact 24 is C-shaped, and includes a contact base 241 and contact extension parts 242 symmetrically arranged at both ends of the contact base 241. Each contact extension part 242 is respectively provided with an elastic contact part 243.

Wherein, each metal conductive ring 23 is respectively located between two contact extension parts 242 of the corresponding metal contact 24, and the elastic contact part 243 of each contact extension part 242 elastically press against the metal conductive ring 23 respectively.

Each metal contact 24 is respectively in contact with the corresponding metal conductive ring 23 through the corresponding elastic contact part 243 and is electrically conductive. The structural design can ensure the stability and reliability of the electric connection between the metal contact 24 and the metal conductive ring 23.

In the fourth embodiment, as shown in FIG. 2, the difference between the fourth embodiment and the first embodiment lies in that in order to facilitate to mount the trunk 11 of the artificial tree body 1, the fourth embodiment is designed by using the following structure. Specifically, an upper end of the supporting base 3 is rotatably provided with a linkage sleeve 5. An upward insertion hole 51 is formed in a core of the linkage sleeve 5. A lower end of the trunk 11 of the artificial tree body 1 is inserted into the insertion hole 51 of the linkage sleeve 5. A lower end of the linkage sleeve 5 is in sleeve connection with an upper end of the rotating shaft core 21 in a non-rotating manner.

In working hours, the driving motor 4 drives the rotating shaft core 21 to rotate, the rotating shaft core 21 drives the trunk 11 to rotate synchronously through the linkage sleeve 5, and then the whole artificial tree body 1 rotates.

In the fifth embodiment, as shown in FIG. 2, the difference between the fifth embodiment and the fourth embodiment lies in that a circle of bottom balls 61 are arranged between a lower surface of the linkage sleeve 5 and the supporting base 3, and the lower surface of the linkage sleeve 5 is in rolling contact with the bottom balls 61.

In addition, the upper end of the supporting base 3 is screwed and fastened with a gland 7 in the shape of a ring. A ball mounting groove 8 in the shape of a ring is formed between the gland 7 and the supporting base 3. A circle of side balls 62 are arranged in the ball mounting groove 8. A side wall of the linkage sleeve 5 is in rolling contact with the side balls 62.

When the linkage sleeve 5 rotates relative to the supporting base 3, the bottom ball 61 can effectively reduce the friction between the lower surface of the linkage sleeve 5 and the supporting base 3, and the side ball 62 can effectively reduce the friction between the side wall of the linkage sleeve 5 and the supporting base 3. That is, through the design of the bottom ball 61 and the side ball 62, the fifth embodiment can effectively improve the smoothness of the rotation of the linkage sleeve 5.

In the seventh embodiment, as shown in FIG. 1, the difference between the seventh embodiment and the first embodiment lies in that the supporting base 3 is provided with a positive and negative rotation control switch 91 for controlling the positive and negative rotation of the driving motor 4.

In addition, the supporting base 3 is provided with a rotating speed control knob 92 for adjusting the rotating speed of the driving motor 4.

In the using process of the rotatable artificial tree according to the seventh embodiment, the user can control the steering and the rotating speed according to the needs. The steering control can be realized by operating the positive and negative rotation control switch 91, and the rotating speed control can be realized by operating the rotating speed control knob 92.

The foregoing is merely a preferred embodiment of the present disclosure, those skilled in the art can make various modifications in terms of specific embodiments and scope of application in accordance with the thoughts of the present disclosure, and the details of the description should not be interpreted as the limitation of the present disclosure.

What is claimed is:

1. A rotatable artificial tree, comprising an artificial tree body (1), a rotatable electric assembly (2) and a supporting base (3), the artificial tree body (1) being provided with decorative light strings (12) and a trunk (11) which is vertically arranged, and the supporting base (3) being provided with a driving motor (4), wherein the rotatable electric assembly (2) comprises a rotating shaft core (21) which is connected with a power output shaft of the driving motor (4) in a non-rotating manner and vertically arranged, the rotating shaft core (21) is connected with the trunk (11) of the artificial tree body (1) in a driving manner, a conductive ring mounting sleeve (22) which rotates synchronously with the rotating shaft core (21) sleeves the periphery of the rotating shaft core (21), at least two metal conductive rings (23) which are arranged at an insulating interval from top to bottom and are respectively in a circular ring shape sleeve the periphery of the conductive ring mounting sleeve (22), and the decorative light strings (12) are electrically connected with the metal conductive rings (23) through wires; and the supporting base (3) is respectively provided with metal contacts (24) corresponding to the metal conductive rings (23), and each metal contact (24) is in contact with the corresponding metal conductive ring (23) and is electrically conductive.

2. The rotatable artificial tree according to claim 1, wherein the supporting base (3) is respectively provided with contact mounting parts (31) corresponding to the metal contacts (24), each contact mounting part (31) is respectively provided with a contact clamping groove (32), and each metal contact (24) is respectively clamped and fixed in the corresponding contact clamping groove (32).

3. The rotatable artificial tree according to claim 1, wherein the metal contact (24) is C-shaped, and comprises a contact base (241) and contact extension parts (242) symmetrically arranged at both ends of the contact base (241), and each contact extension part (242) is respectively provided with an elastic contact part (243); and each metal conductive ring (23) is respectively located between two contact extension parts (242) of the corresponding metal contact (24), and the elastic contact part (243) of each contact extension part (242) elastically press against the metal conductive ring (23) respectively.

4. The rotatable artificial tree according to claim 1, wherein an upper end of the supporting base (3) is rotatably provided with a linkage sleeve (5), an upward insertion hole (51) is formed in a core of the linkage sleeve (5), and a lower end of the trunk (11) of the artificial tree body (1) is inserted into the insertion hole (51) of the linkage sleeve (5); and a lower end of the linkage sleeve (5) is in sleeve connection with an upper end of the rotating shaft core (21) in a non-rotating manner.

5. The rotatable artificial tree according to claim 4, wherein a circle of bottom balls (61) are arranged between a lower surface of the linkage sleeve (5) and the supporting base (3), and the lower surface of the linkage sleeve (5) is in rolling contact with the bottom balls (61).

6. The rotatable artificial tree according to claim 4, wherein the upper end of the supporting base (3) is screwed and fastened with a gland (7) in the shape of a ring, a ball mounting groove (8) in the shape of a ring is formed between the gland (7) and the supporting base (3), a circle of side balls (62) are arranged in the ball mounting groove (8), and a side wall of the linkage sleeve (5) is in rolling contact with the side balls (62).

7. The rotatable artificial tree according to claim 1, wherein the supporting base (3) is provided with a positive and negative rotation control switch (91) for controlling the positive and negative rotation of the driving motor (4).

8. The rotatable artificial tree according to claim 1, wherein the supporting base (3) is provided with a rotating speed control knob (92) for adjusting the rotating speed of the driving motor (4).

* * * * *